United States Patent [19]

Takizawa et al.

[11] Patent Number: 4,978,966

[45] Date of Patent: Dec. 18, 1990

[54] CARBORNE ANTENNA

[75] Inventors: Akio Takizawa; Fumio Furuta; Syozo Saito, all of Warabi, Japan

[73] Assignee: Nippon Antenna Co., Ltd., Tokyo, Japan

[21] Appl. No.: 367,447

[22] Filed: Jun. 16, 1989

[30] Foreign Application Priority Data

| | | | |
|---|---|---|---|
| Jun. 24, 1988 | [JP] | Japan | 63-156056 |
| Aug. 24, 1988 | [JP] | Japan | 63-209783 |
| Sep. 26, 1988 | [JP] | Japan | 63-242097 |

[51] Int. Cl.[5] ..... H01Q 1/000; H01Q 7/080; H01Q 1/320

[52] U.S. Cl. ..... 343/788; 343/867; 343/895

[58] Field of Search ..... 343/713, 717, 787, 788, 343/895, 711, 712, 824, 867, 900; 336/20, 130, 131

[56] References Cited

U.S. PATENT DOCUMENTS

| | | | |
|---|---|---|---|
| 2,727,147 | 12/1955 | Craumer | 336/131 |
| 2,748,386 | 5/1956 | Polydoroff | 343/787 |
| 4,163,981 | 8/1979 | Wilson | 343/895 |
| 4,229,743 | 10/1980 | Vo et al. | 343/895 |
| 4.658,259 | 4/1987 | Blaese | 343/826 |

FOREIGN PATENT DOCUMENTS

| | | | |
|---|---|---|---|
| 3309405 | 9/1984 | Fed. Rep. of Germany | 343/901 |
| 0840850 | 7/1960 | United Kingdom | 343/895 |

OTHER PUBLICATIONS

Japanese Patent Application Publication 45-2121 Multimode Helical Dipole Antenna Matsushita Denki KK Jul., 25, 1966, 3 pages.

A Self-Diplexing Omni-Directional Antenna Ono et al., Mitsubishi Electric Co. pp. 331-334.

*Primary Examiner*—Rolf Hille

*Assistant Examiner*—Peter Toby Brown

*Attorney, Agent, or Firm*—Flynn, Thiel, Boutell & Tanis

[57] ABSTRACT

An antenna has a plurality of rod-shaped cores aligned in an end-to-end relationship and an antenna coil wound on the core array throughout its entire length. This arrangement permits the antenna to bend and fit any curved surface of a car where the antenna is mounted.

6 Claims, 4 Drawing Sheets

CARBORNE ANTENNA

FIELD OF THE INVENTION

This invention relates to a carborne antenna, in particular an antenna in the form of a plurality of rod-shaped cores which can receive signals although they are mounted so as to be close to and not project from a car body, which can be mounted along a curved surface when its mounting portion is not flat, and which ensures a favorable signal reception when the signal incoming direction is changed during navigation of the car.

BACKGROUND OF THE INVENTION

Most of known carborne antennas are pole-type antennas (whip antennas) which project from their car bodies.

In some cars, a so-called glass antenna in the form of a wire embedded in a window glass is used. It is further proposed to receive signals by detecting a high-frequency current induced in the roof, etc. of a car body, using a pick-up coil.

Some pole-type antennas are stationary in a projecting configuration, and some of them can be extended and contracted by a user. In both designs, there is a great possibility that they are snapped off or bent accidentally and lose their signal receiving function. Further, different mounting arrangements including most suitable water-proof mechanisms are required for different car models. Besides, since each such antenna is designed to be optimum under a specific band, some antennas for different specific reception bands must be mounted on a car for acceptable wide-band reception. These factors apparently damage a good appearance of a car (in particular, passenger car, etc.). A glass antenna is one of the alternatives which does not project to the exterior of the car and maintains the good appearance of the car. However, considering that the reception band is broadened in these days, such a glass antenna does not have a sufficient capacity, and a user is forced to use it in addition to one or more pole-type antennas.

The above-introduced arrangement configured to pick up a high-frequency current induced in the roof, etc. of a car is in the form of a relatively small-scaled magnetic member (ferrite core) which is wound with a coil. This appears to be operative in strong electric field areas. However, in weak electric field areas where the current induced in the car body is small, the detected amount is too small to obtain an acceptable receiving sensitivity because a booster, if used for amplifying the small detection amount, also picks up engine noises, etc.

Besides this, when a member thereof operative as an antenna element is positioned close to a conductive member such as a car body, changes occur in electrical characteristics of the antenna. Therefore, it must be isolated from other conductive members as in the case of pole-type antennas. This is because an antenna equivalent circuit is in the form of a distributed constant circuit of L, C and R as is known in general, and it loses a stable antenna function because of changes in L, C and R when any other conductor (metal member including a car body) is near the antenna. Therefore, when it is used as a carborne antenna, its function is affected by its mounting condition.

OBJECT OF THE INVENTION

It is therefore an object of the invention to provide a carborne antenna which can be mounted in a condition not projecting to the exterior of a car and along any curved surface or contour of the car body and which maintains a good reception sensitivity in a weak electric field.

A further object of the invention is to provide a carborne antenna which is easily manufactured.

A still further object of the invention is to provide a carborne antenna which is not affected by a conductor located therearound.

SUMMARY OF THE INVENTION

An antenna of the invention includes a plurality of rod-shaped cores which are aligned in an end-to-end relationship permitting flexibility between respective cores and are wound with a coil throughout the full length thereof.

Since the rod-shaped cores are aligned in an end-to-end relationship and a coil is wound on the cores throughout their full length, and since the cores are held in alignment by turns of the coil so that they each can slightly pivot about one end opposed to one end of an adjacent core, the antenna can bend as a whole and can be mounted along any curved surface of a car body if necessary.

When the antenna of the invention is mounted along an exterior surface of a car, it catches direct waves or reflected waves. When it is mounted in the car cabin, it catches a current induced in the car body or direct waves coming through an opening window.

That is, current induced in the car body or direct incoming electric waves are converged to the antenna magnetic core. In this case, the greater the cross-sectional area of the core, the higher the converging ratio is. Further, by adjusting the length of the coil itself to the received wavelength, the antenna can effectively catch magnetic field waves and electric field waves. It is acknowledged by experiments that the reception capacity of the inventive antenna is as good as pole-type antennas in a weak electric field.

DETAILED DESCRIPTION

Figure 1:
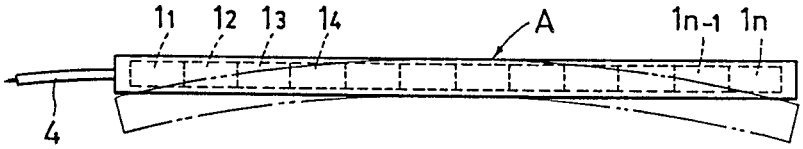
FIG. 1 is a general aspect of an antenna arrangement embodying the invention.
Figure 2:
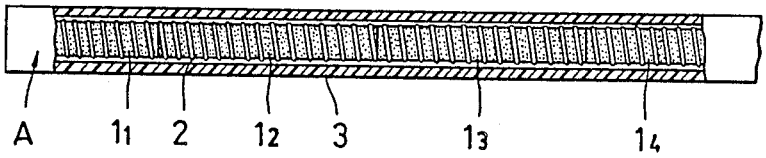
FIG. 2 is a partly cut-out, cross-sectional view which shows the interior arrangement of the antenna of FIG. 1.
Figure 3:
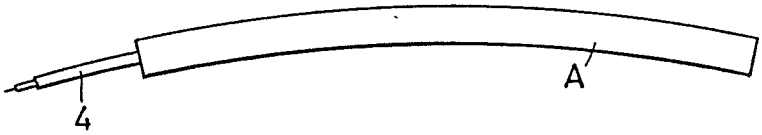
FIGS. 3(*a*) and 3(*b*) are views which show how the antenna can be bent or curved.
Figure 3:
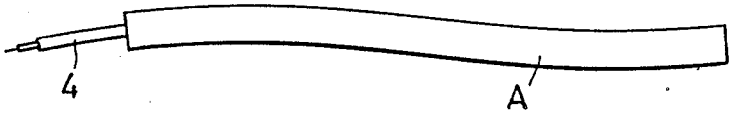
Figure 5:
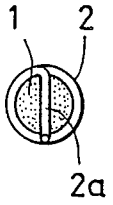
FIG. 5 is an end view of the embodiment of FIG. 4.
Figure 4:
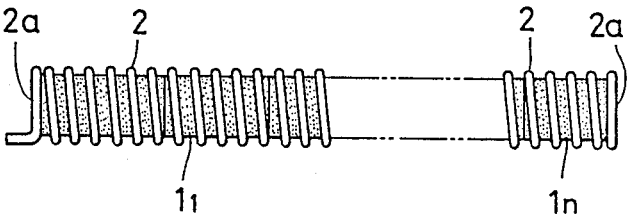
FIG. 4 is a fragmentary side elevation of a further embodiment of the invention.
Figure 6:
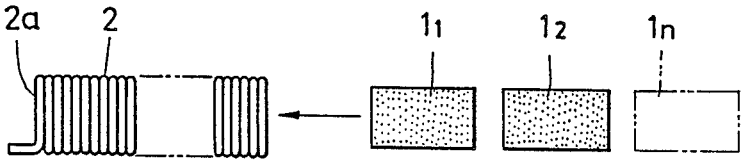
FIG. 6 is a view how the antenna of FIG. 4 is produced.
Figure 7:
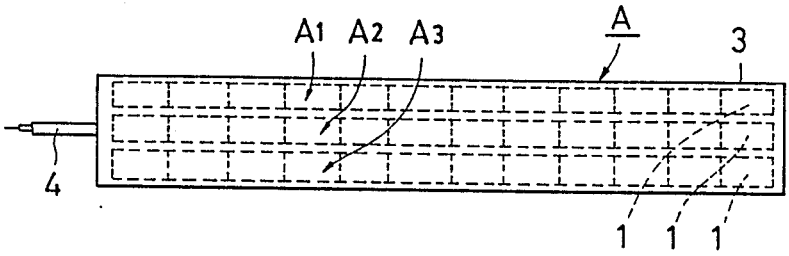
FIG. 7 is a plan view of a still further embodiment of the invention.
Figure 8:
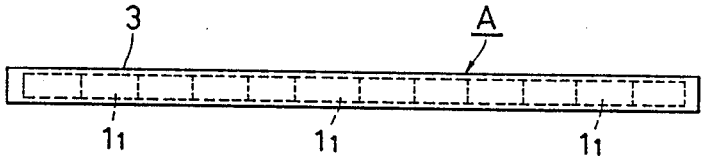
FIG. 8 is a side elevation of the embodiment of FIG. 7.
Figure 9:
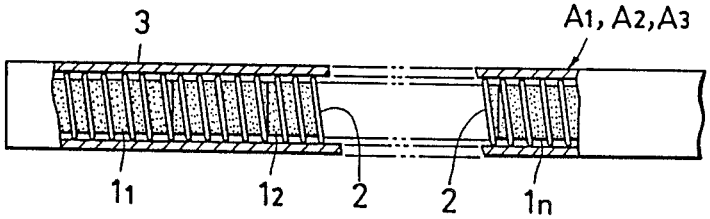
FIG. 9 is a fragmentary enlarged cross-sectional view of an antenna element in the embodiment of FIG. 7.

The invention is described below, referring to preferred embodiments illustrated in the drawings. FIG. 1 shows an antenna A made by arranging a plurality of ferrite cores or other rod-shaped cores $1_1$, $1_2$, $1_3$ . . . $1_n$ in end-to-end alignment and by winding an antenna coil 2 on the cores throughout the entire length thereof. A cable 4 is extended from the antenna coil 2 for connection with a receiver (not shown). The interior of the antenna A is as shown in FIG. 2 where the rod-shaped cores $1_1$, $1_2$, . . . $1_n$ are arranged as explained above and are held in relative connection by the antenna coil 2. Its outer periphery is covered by an insulator 3. The insulator 3 may be a flexible synthetic resin, for example, in the form of a heat-shrinkable tube or a thin-skin molded tube. Since the rod-shaped cores $1_1$, $1_2$, . . . $1_n$ are held in a serial linkage by the antenna coil 2 alone, more or less bending flexibility is permitted between respective adjacent rod-shaped cores to bend the antenna entirely or partly as shown by imaginary lines in FIG. 1. Therefore, the antenna A, when mounted, can fit the contour of a car body also when the body line is curved. FIGS. 3(*a*) and 3(*b*) show such mounting examples. In the car cabin, for example, the antenna A can be mounted near the rear bumper, at the right or left bottom of the car body or along the surface of the panel portion. In order to improve the appearance of the antenna A, a cord-knitted cover may be used as an armor. Thus the antenna A can be mounted anywhere on the car. FIGS. 4 to 6 show a further embodiment of the invention.

In the drawings, a carborne antenna A includes an array of ferrite cores or other rod-shaped cores aligned in an end-to-end relationship, a resilient antenna coil 2 wound on the core array throughout the entire length thereof, and an insulator 3 in the form of a flexible synthetic resin tube which covers the outer periphery of the antenna coil 2. When the resilient antenna coil 2 is mounted on the core array, it is extended from a spaceless winding configuration to a spaced winding configuration, and bent portions 2*a* at opposite ends thereof are engaged with opposite end surfaces of the rod-shaped cores 1 located at opposite ends of the core array, so that the cores are held in an end-to-end connected relationship permitting the entire core array to bend. Reference numeral 4 denotes a cable extended from the antenna coil 2 for connection with a receiver.

FIG. 6 shows an example how the resilient antenna coil 2 is wound on the rod-shaped core 1.

More specifically, a spaceless winding coil having a number of turns is used as the resilient antenna coil 2. One end of the interior space defined by the coil 2 terminates at the bent portion 2*a*, and a desired number of rod-shaped cores 1 are sequentially inserted in the interior space from the other opening end. After the final core 1 is inserted, another bent portion 2*a* is formed by bending the other end of the coil 2, and it is engaged with the end surface of the last inserted core 1. As a result, the originally spaceless winding resilient coil 2 is expanded into a spaced winding configuration, with respective turns being uniformly spaced throughout the entire length of the core array, and holds therein the rod-shaped cores in a bendable condition.

FIGS. 7 to 12 show a still further embodiment of the invention.

In the drawings, a carborne antenna A of antenna elements $A_1$, $A_2$ and $A_3$ each made a number of ferrite cores or other rod-shaped cores aligned in an end-to-end relationship and an antenna coil 2 wound on the core array throughout the entire length thereof. The antenna elements $A_1$, $A_2$ and $A_3$ each have a length of $\lambda/4$ ($\lambda$ is the wavelength). The antenna elements $A_1$, $A_2$ and $A_3$ are assembled in a side-by-side relationship by wrapping them together by an insulator 3 in the form a flexible synthetic resin tube shown in FIGS. 11 and 12.

When making the antenna element, the antenna coil 2 may be wound on the rod-shaped core array. Alternatively, the rod-shaped cores 1 may be inserted in the interior space defined by the coil precedingly made by shaping a resilient wire member into a spaceless winding configuration but expanded into a spaced winding configuration as the cores 1 are inserted therein, and opposite ends of the resilient coil are engaged with opposite end surfaces of the core array.

When using the carborne antenna, respective ends of the coils of the antenna elements $A_1$, $A_2$ and $A_3$ are connected in parallel, and feed a receiver via a cable 4. Each of the antenna elements $A_1$, $A_2$ and $A_3$ not only functions as an antenna but also behaves as a stabilizing element for the other antenna elements.

Figure 10:
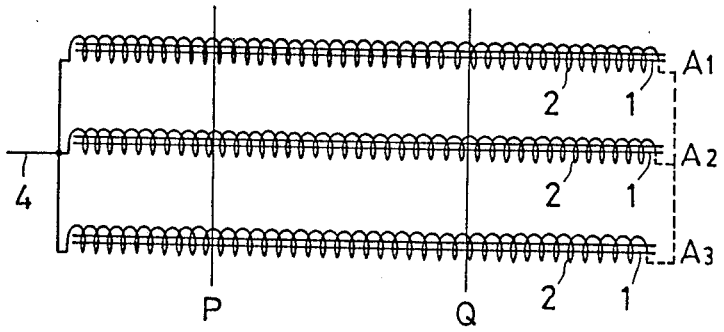
FIG. 10 is a view for explaining the antenna arrangement in the embodiment of FIG. 7.
Figure 11:
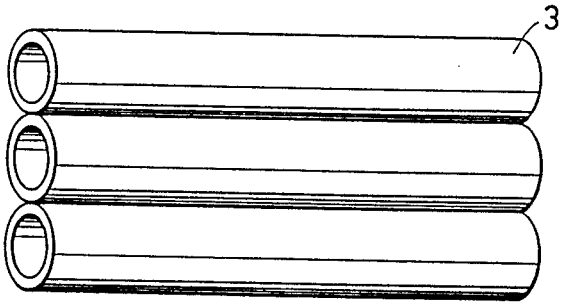
FIGS. 11 and 12 are perspective views of an insulator which covers the antenna element in the embodiment of FIG. 7.
Figure 12:
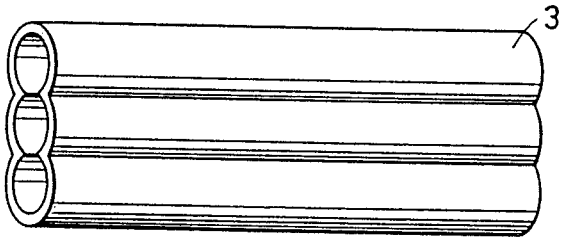

The antenna operates as described below, referring to FIG. 10.

The antenna elements $A_1$, $A_2$ and $A_3$ are identical in arrangement, and have an identical current distribution according to the wavelength of the received band. At any points such as point P and point Q indicated in the drawing, the electric potentials between respective antenna elements $A_1$, $A_2$ and $A_3$ are equal. Therefore, no change is produced in the distributed constant of L, C, R between respective antenna elements. When $A_2$ operates as an antenna element, $A_1$ and $A_3$ behave as stabilizing elements, and when $A_1$ or $A_3$ operates as an antenna element, the remainder $A_2$ and $A_3$ or $A_2$ and $A_1$ behave as stabilizing elements. Also when the coils are connected at both ends as also shown by a dotted line in FIG. 10, no change is produced in the current distributing condition, and the same result is obtained.

That is, since all the antenna elements are identical in current distributing condition, they are also identical in voltage distribution. Therefore, the electric potentials in adjacent elements are equal in any point, and when a conductor is positioned near the antenna, each antenna element can maintain the substantially same constant due to the presence of the other elements. That is, each antenna element is stabilized, and not affected by the approach of a conductor. As a result, the antenna of the invention may be mounted in any position close to the car body or in a non-favorable mounting condition. The embodiment is illustrated as having three antenna elements. However, the parallel feeding elements may be increased to reinforce the stabilizing effect.

Since each antenna element has a flexible arrangement where the coil is wound on the core array, the antenna is readily mounted along any curved surface of a car body. Additionally, when increasing the number of cores of each antenna element to increase the converging ratio to the magnetic core, the antenna can catch electromagnetic waves more effectively, and exhibits an excellent reception capacity in a weak electric field, not inferior to pole-type antennas as acknowledged by experiments.

As described above, since the antenna of the invention includes a plurality of rod-shaped cores connected in an end-to-end relationship to form a bendable magnetic core, it can be mounted along any curved contour of a car body, exterior or interior of the car, of all car models. Further, the converging ratio is increased not only in a strong electric field but also in a weak electric field, and by winding a coil having a length corresponding to the wavelength of the received band, a good acoustic sense and a good reception sensitivity are maintained regardless of any change in the wavelength of the received band.

What is claimed is:

1. A carborne antenna, comprising: a plurality of core arrays, each having a plurality of rod-shaped cores arranged in an end-to-end relationship and an antenna coil bendably wound on the core array along the entire length thereof, each said antenna coil having first and second ends; wherein said core arrays are disposed in a side-by-side relationship and said first ends of said antenna coils of said core arrays are adjacent and connected together to form a parallel feeding terminal, all of said core arrays being identical in current and voltage distribution so that one of said core arrays operates as an antenna element while the rest of said core arrays behave as stabilizing elements; including a flexible insulator which covers the outer periphery of each said antenna coil; wherein said insulator has extending therethrough a plurality of spaced, lengthwise openings which are parallel, and wherein each said core array is disposed in a respective said opening in said insulator.

2. The carborne antenna according to claim 1, wherein said insulator has three of said lengthwise openings therethrough, one of which is disposed between the other two, and wherein said antenna has three of said core arrays which are each disposed in a respective said opening.

3. The carborne antenna according to claim 1, wherein each of said rod-shaped cores is solid, substantially cylindrical, and made of ferrite.

4. The carborne antenna according to claim 1, wherein said core arrays are identical.

5. The carborne antenna according to claim 1, wherein said second ends of said coils are all connected together.

6. The carborne antenna according to claim 5, wherein the length of each said core array is approximately one quarter of the length of the wavelength of a signal to be received by the antenna.

* * * * *